US009404326B2

(12) United States Patent
Zhou

(10) Patent No.: US 9,404,326 B2
(45) Date of Patent: Aug. 2, 2016

(54) DOWNHOLE TOOL FOR USE IN A DRILL STRING

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 531 days.

(21) Appl. No.: 13/828,244

(22) Filed: Mar. 14, 2013

(65) Prior Publication Data

US 2013/0269928 A1 Oct. 17, 2013

Related U.S. Application Data

(60) Provisional application No. 61/623,786, filed on Apr. 13, 2012.

(51) Int. Cl.

| | |
|---|---|
| ***E21B 17/18*** | (2006.01) |
| ***E21B 17/06*** | (2006.01) |
| ***E21B 21/12*** | (2006.01) |
| ***E21B 34/10*** | (2006.01) |
| ***E21B 21/00*** | (2006.01) |

(Continued)

(52) U.S. Cl.

CPC ..... *E21B 21/003* (2013.01); *E21B 17/06* (2013.01); *E21B 21/08* (2013.01); *E21B 21/103* (2013.01)

(58) Field of Classification Search

CPC ..... E21B 17/18; E21B 17/02; E21B 17/06; E21B 21/12; E21B 34/063; E21B 34/10

USPC ..... 166/242.6, 374, 319, 321, 332.1, 334.4

See application file for complete search history.

(56) References Cited

U.S. PATENT DOCUMENTS 3,363,696 A * 1/1968 Berryman ..... 166/334.4
3,989,114 A 11/1976 Tschirky et al.

(Continued)

FOREIGN PATENT DOCUMENTS

GB 2480559 A 11/2011

OTHER PUBLICATIONS

PCT the International Search Report and the Written Opinion of the International Searching Authority dated Sep. 2, 2014; International Application No. PCT/US2013/036096; International File Date: Apr. 11, 2013.

(Continued)

*Primary Examiner* — Kenneth L Thompson

(74) *Attorney, Agent, or Firm* — Bracewell LLP; Constance G. Rhebergen; Keith R. Derrington

(57) ABSTRACT

A downhole tool in a drill string for mitigating hazards of a blockage in an annulus of the drill string. The downhole tool can sense blockages and selectively recirculate flow from within the annulus back to surface. Further, the downhole tool is made up of segments that are selectively detachable from one another, so that the segments above the point of detachment are removable from a wellbore. The bypass assembly includes a sleeve in the downhole tool with openings in its side; when the annulus reaches a set pressure, the sleeve slides to a position so the openings register with ports formed through a side of the tool to allow bypass flow. A processor in the downhole tool senses movement of the string, and when the string is axially stationary more than a designated period of time, the processor emits signals to detach the segments.

14 Claims, 9 Drawing Sheets

(51) Int. Cl.
*E21B 21/10* (2006.01)
*E21B 21/08* (2006.01)

(56) References Cited

U.S. PATENT DOCUMENTS

| | | | | |
|---|---|---|---|---|
| 4,396,071 | A | 8/1983 | Stephens | |
| 4,576,235 | A * | 3/1986 | Slaughter et al. | 166/374 |
| 4,632,193 | A | 12/1986 | Geczy | |
| 4,889,199 | A | 12/1989 | Lee | |
| 5,499,687 | A | 3/1996 | Lee | |
| 5,526,888 | A * | 6/1996 | Gazewood | 175/320 |
| 5,718,291 | A | 2/1998 | Lorgen et al. | |
| 5,730,222 | A | 3/1998 | Rike, Jr. | |
| 5,890,540 | A | 4/1999 | Pia et al. | |
| 6,095,249 | A | 8/2000 | McGarian et al. | |
| 6,102,126 | A | 8/2000 | Huber et al. | |
| 6,173,795 | B1 | 1/2001 | McGarian et al. | |
| 6,263,969 | B1 | 7/2001 | Stoesz et al. | |
| 6,289,999 | B1 | 9/2001 | Dewey et al. | |
| 6,293,342 | B1 * | 9/2001 | McGarian et al. | 166/317 |
| 6,378,612 | B1 * | 4/2002 | Churchill | 166/319 |
| 6,425,443 | B1 | 7/2002 | Hill et al. | |
| 6,439,305 | B1 * | 8/2002 | Bakke | 166/242.6 |
| 7,069,991 | B2 | 7/2006 | Gudmestad et al. | |
| 7,100,696 | B2 | 9/2006 | Marshall | |
| 7,152,674 | B2 | 12/2006 | Bowles | |
| 7,373,974 | B2 | 5/2008 | Connell et al. | |
| 7,549,485 | B2 | 6/2009 | Radford et al. | |
| 7,766,084 | B2 * | 8/2010 | Churchill | 166/320 |
| 7,926,574 | B2 | 4/2011 | Mondelli et al. | |
| 7,992,638 | B2 | 8/2011 | Benton et al. | |
| 2004/0011566 | A1 | 1/2004 | Lee | |
| 2009/0056952 | A1 | 3/2009 | Churchill | |
| 2012/0018152 | A1 | 1/2012 | Van Zuilekom et al. | |
| 2012/0031615 | A1 | 2/2012 | Connell et al. | |

OTHER PUBLICATIONS

PCT Partial International Search Report of the International Searching Authority dated Jun. 25, 2014; International Application No. PCT/US2013/036096; International File Date: Apr. 11, 2013.

* cited by examiner

DOWNHOLE TOOL FOR USE IN A DRILL STRING

CROSS REFERENCE TO RELATED APPLICATIONS

This application claims priority to and the benefit of U.S. Provisional Application Ser. No. 61/623,786, filed Apr. 13, 2012, the full disclosure of which is hereby incorporated by reference herein for all purposes.

BACKGROUND OF THE INVENTION

1. Field of the Invention

The present invention relates to operations in a wellbore. More specifically, the invention relates to a system and method for mitigating hazards associated with use of a drill string.

2. Description of the Related Art

Hydrocarbon producing wellbores extend subsurface and intersect subterranean formations where hydrocarbons are trapped. The wellbores generally are created by drill bits that are on the end of a drill string, where a drive system above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore. The drilling fluid flows back up the wellbore in an annulus between the drill string and walls of the wellbore. Cuttings produced while excavating are carried up the wellbore with the circulating drilling fluid. Drill strings are typically made up of tubular sections attached by engaging threads on ends of adjacent sections to form threaded connections. New tubular sections are attached to the upper end of the drill string as the wellbore deepens and receives more of the drill string therein. Drill string rotation is temporarily suspended each time a tubular section is added to the drill string.

To overcome dynamic losses in the drill string while drilling, sometimes high solids mud and or large amounts of loss circulation material (LCM) are pumped downhole. These solids can plug the drill string thus preventing fluid from flowing through the drill bit. If the well starts to produce while the drill string is plugged, flow cannot be circulated through the drill string to kill the well, thereby introducing the possibility of a blowout. Another undesirable situation resulting from a plugged drill string is that the drill string can become stuck against the wellbore wall.

SUMMARY OF THE INVENTION

Described herein is an example of a downhole device that selectively couples with a drill string, and which can mitigate hazards of a blockage in an annulus of the drill string. In an example embodiment disclosed is a downhole sub that is selectively coupled in series with a drill string, where the downhole sub includes a bypass sub having a housing with an outer surface, an annulus axially disposed in the housing, a relief valve assembly in a side wall of the housing that is selectively moveable from a closed position with the outer surface isolated from the annulus to an open position with the fluid communication between the annulus and outer surface, and a passage in the side wall of the housing having an end in communication with the annulus and a distal end in communication with the relief valve assembly. The relief valve assembly can include an annular space formed axially in the side wall of the housing, a sleeve axially moveable in an annular space formed axially in the side wall of the housing, an opening radially formed through a side wall of the sleeve, and a port formed radially through the housing that registers with the opening when the valve assembly is in the open position. In this example, the relief valve assembly can also include a poppet valve in the passage that is selectively moveable to an open position when pressure in the annulus exceeds a designated value. Further in this example is that the relief valve can include a piston head on an end of the sleeve that has a high pressure side in pressure communication with the passage, and a spring on a side of the piston distal from the high pressure side to bias the piston and sleeve into the closed position. In an alternate example, the annulus has diameter with a magnitude that remains substantially the same along a length of the annulus. The downhole sub may further include a disconnect sub having upper and lower members that are selectively coupled by a latch assembly. This example may also include a motion detector and a controller for actuating the latch assembly, and further optionally include a piston movable in a cylinder that is axially formed within the disconnect sub and having a low pressure side in communication with the latch assembly, a pressure vent in communication with fluid ambient to the sub system and having an end intersecting a high pressure end of the cylinder, a control valve for controlling flow through the pressure vent, and a controller for controlling operation of the control valve and that is in communication with the motion detector, so that when the motion detector detects a period of time that the sub system is motionless which exceeds a designated period of time, the controller directs the control valve to open, which pressurizes the cylinder and actuates the latch assembly. In an example of the downhole sub of claim 8, the latch assembly is made up of a latch rod that selectively moves from within interfering contact between the upper and lower members into a one of the upper or lower members. In an alternative, the lower member has elongated clutch members that project axially into slots on the upper segment and wherein the latch rod extends from within a chamber in each of the clutch members and into a chamber in each of the slots when the upper and lower members are connected to one another, and where the latch rod is withdrawn from one of the chambers when the upper and lower members are separable.

Also disclosed herein is an alternative embodiment of a downhole sub for use in a borehole, where the downhole sub has an end connected with a length of a tubular and an opposite end connected with a length of a tubular to define a drill string, a bypass sub for selectively diverting fluid from within the drill string to the borehole, and a disconnect sub having upper and lower members that selectively decouple when the drill string remains motionless for more than a designated period of time. Optionally, a flow path is provided that projects axially through the bypass sub having a diameter that remains substantially the same along an axial length of the bypass sub. In an embodiment, a relief valve assembly is provided in a side wall of the bypass sub, so that when fluid in the bypass sub exceeds a designated value, the fluid in the bypass sub is selectively diverted from within the drill string to the borehole. The upper and lower members can be coupled by a coupling assembly that includes castellated elements on both the upper and lower members that insert into slots formed between the castellated elements. In this example, the coupling assembly further has chambers formed laterally in the castellated elements, and a latch rod that selectively moves within chambers in the castellated elements, wherein the latch rod is hydraulically actuated. In one example embodiment, fluid in the borehole provides a pressure source for operating the bypass sub and the disconnect sub.

Another example embodiment of a downhole sub is disclosed that selectively couples in series with a drill string. In this example the downhole sub is made up of a bypass sub having a housing with an outer surface, an annulus axially disposed in the housing, a relief valve assembly in a side wall of the housing that is selectively moveable from a closed position with the outer surface isolated from the annulus to an open position with the fluid communication between the annulus and outer surface, a disconnect sub having upper and lower members selectively coupled by a latch assembly, an actuation system in communication with the latch assembly and in communication with fluid ambient to the downhole sub, a motion detector, and a controller in communication with the motion detector and the actuation system, so that when the motion detector senses a designated period of motionless, a signal is sent to the controller to decouple the upper and lower members. In this embodiment, a bit can be mounted on a lower terminal end of the drill string, and a downhole tool is between the downhole sub and the bit. In an alternative, a downhole tool is mounted in a portion of the drill string between the downhole sub and an opening of a wellbore in which the drill string is inserted.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
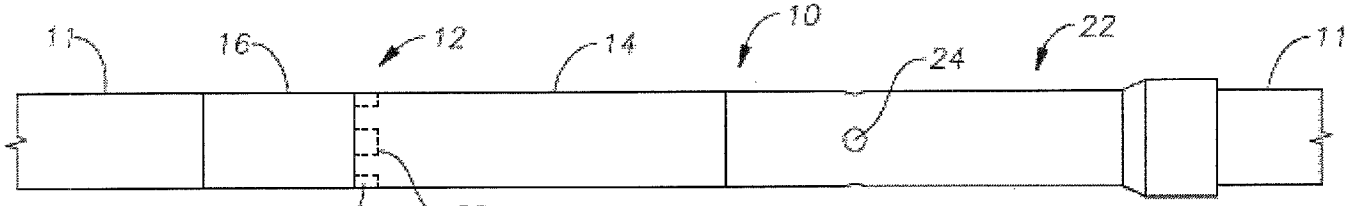
FIG. 1 is a side view of an example embodiment of a downhole tool for use in a drill string in accordance with the present invention.

Shown in FIG. 1 is a side view of an elongated downhole tool 10 for use in a wellbore and for mitigating hazards that may occur during drilling. In one example embodiment, the downhole tool 10 is integrally included within a drill string 11. Included with the downhole tool 10 of FIG. 1 is a disconnect sub 12 shown having an upper member 14 and lower member 16, where upper member 14 selectively connects and disconnects from lower member 16. In the example of FIG. 1, the upper and lower members 14, 16 are generally annular and having a substantially circular outer surface. Clutch members 18 are provided on an upper end of the lower member 16 and are shown projecting into slots 20 formed on a lower end of the upper member 14. The clutch members 18 and slots 20 respectively circumscribe the lower member 16 and upper member 14. As the clutch members 18 and slots 20 are within the outer surface of the tool 10, they are illustrated by a dashed line. The rectangular outer periphery of the clutch members 18 and slots 20 create a castellated profile along their interface. The downhole tool 10 also includes a bypass sub 22 shown above the disconnect sub 12. In the example of FIG. 1, the bypass sub 22 has a substantially circular outer periphery. Ports 24 extend through the side wall of the bypass sub 22 along a path that circumscribes its outer surface at an axial location.

Figure 2B:
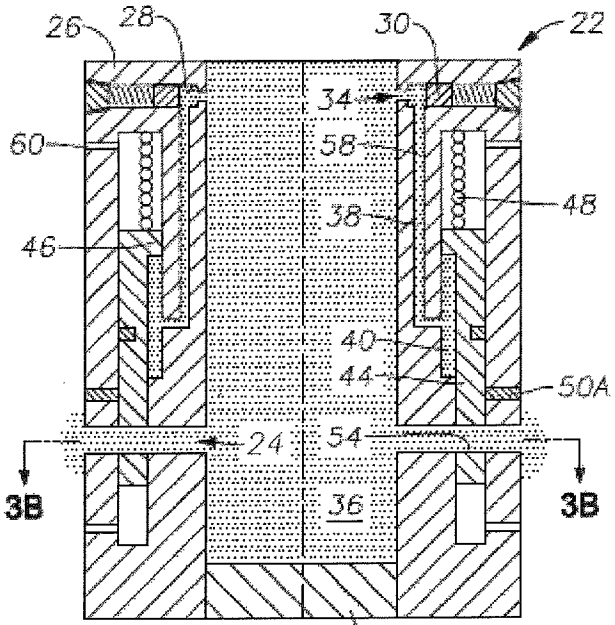
FIG. 2B is a side sectional view of an example of a circulation sub in the downhole tool of FIG. 1 in an open position and in accordance with the present invention.
Figure 2A:
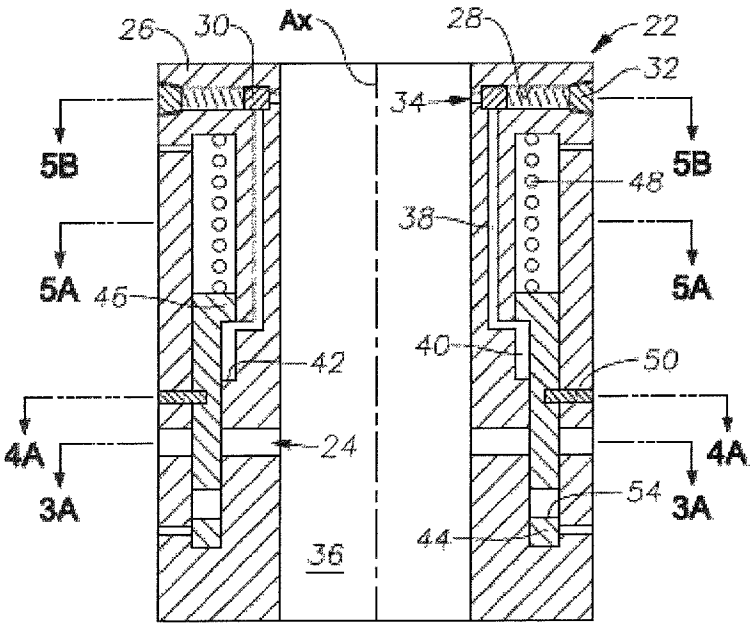
FIG. 2A is a side sectional view of an example of a circulation sub in the downhole tool of FIG. 1 in a closed position and in accordance with the present invention.

FIGS. 2A and 2B illustrate in side sectional view examples of the bypass sub 22 respectively in a closed and open position. In the closed position depicted in FIG. 2A, the bypass sub 22 is shown having a sidewall 26, where a bore 28 extends radially through the sidewall 26. A spring valve 30 is set within the bore 28, and a plug 32 inserted in the bore 28 on an outer surface of the sidewall 26 retains the spring valve 30 within bore 28. Embodiments of the spring valve 30 include stacked Belleville washers/springs and a coil spring with a piston like disk on the end facing inlet 34 that seals against the walls of the bore 28. Proximate an inner radius of the sidewall 26, the diameter of the bore 28 is reduced and defines an inlet 34 to the bore 28 from an annulus 36 shown extending axially through the bypass sub 22. An axial passage 38 is formed axially in the sidewall 26 and has an end that intersects the bore. Distal from the bore 28, the passage 38 projects radially redirected radially outward and intersects with an annular chamber 40 formed in the sidewall 26. The annular chamber 40 has an elongate side disposed substantially parallel with an axis $A_X$ of the bypass sub 22 and extends downward past a lower end of passage 38 and axially upward towards bore 28. A transition 42 in the chamber 40 defines a change in its radial diameter. Above the transition 42 a radius of the chamber 40 is greater than the radius of the chamber 40 below transition 42. For the purposes of discussion herein, the spring valve 30 can be referred to as a poppet valve for selectively allowing flow from the annulus 36 to the passage 38.

An annular sleeve 44 is shown disposed within the chamber 40 and having a portion extending below and above transition 42. Mounted on an upper end of the example of the sleeve 44 of FIG. 2A is a piston head 46 whose radial thickness substantially matches the radial thickness of the chamber 40 above transition 42. In one example, the piston head 46 sealingly contacts the walls of the annular chamber 40 to form a pressure barrier in the chamber 40 along the region of contact. A spring 48 is shown set within the annular chamber 40 on an upper axial surface of the piston head 46 for downwardly biasing piston head 46 and sleeve 44. In the example of FIG. 2A, a shear pin 50 extends radially outward from the sleeve 44 and through a radial bore in the sidewall 26, thereby retaining sleeve 44 in the position of FIG. 2A. Below the transition 42, a port 24 extends radially through the sidewall 26 from the annulus 36 and to an outer circumference of the bypass sub 22. Further illustrated in FIG. 2A is an opening 54 formed radially through the sleeve 44, but at an axially location offset from port 24. Thus in the example of FIG. 2A, a solid portion of the sleeve 44 intersects the port 24 and blocks flow from the annulus 36 into the outer surface of the bypass sub 22.

Referring now to FIG. 2B, a plug 56 is schematically represented in the annulus 36 past a terminal end of the chamber 40 distal from the bore 28. The plug 56 is to block flow axially through the annulus 36; as described above, the plug 56 may introduce a hazard if flow through the drill string 11 (FIG. 1) is not allowed to circulate back to surface. In this example, the presence of the plug 56 increases fluid pressure in the annulus 36, that communicates through inlet 34 to spring valve 30. Above a threshold value, the pressure in the annulus 36 compresses spring valve 30 radially outward and away from inlet 34. Continued application of pressure to the spring valve 30 further compresses it so its radial inward end is urged outward past the passage 38; which allows fluid 58 from annulus 36 to flow through the passage 38 and into the annular chamber 40. Introducing the pressurized fluid 58 into the chamber 40 exerts an upward force on the sleeve 44 as the fluid 58 contacts a lower facing surface of the piston head 46. With sufficient force on the piston head 46, the biasing force of the spring 48 is overcome so that the spring 48 is compressed as the sleeve 44 is moved upward. Ultimately, the opening 54 in sleeve 44 registers with port 24 thereby providing a fluid flow path from annulus 36 to outside of the bypass sub 22. As such, fluid flowing downward through drill string 11 (FIG. 1) from surface can be bypassed from the drill string 11, to an outer annulus between the drill string 11. Optionally, fluid flow can be between downhole tool 10 (FIG. 1) and wellbore wall (not shown), and back to surface. Further shown in the example of FIG. 2B is that the shear pin 50A has been sheared after the upward force supplied to the piston head 46 overcomes the shear strength within the shear pin 50. As the sleeve 44 in piston head 46 moves upward within the annular chamber 40, any fluid in the chamber 40 above piston head 46 can escape from the bypass sub 22 from pressure vents 60 that extend radially outward through the side wall 26 from the annular chamber 40 and intersect with an outer surface of the bypass sub 22. For the purposes of discussion herein, one or more of the sleeve 44, piston head 46, spring 48, and poppet valve can be referred to as a relief valve assembly.

Figure 3A:
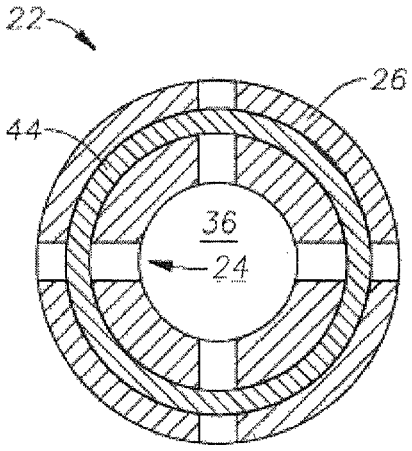
FIG. 3A is an axial sectional view of the circulation sub of FIG. 2A taken along lines 3A-3A and in accordance with the present invention.
Figure 3B:
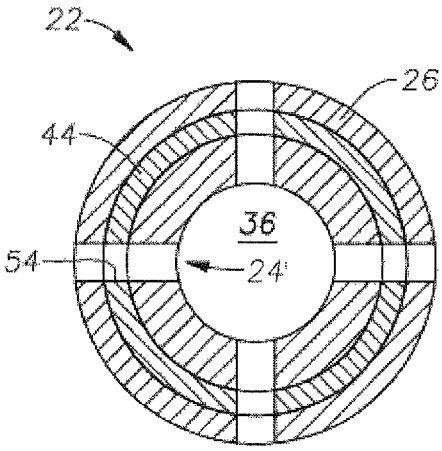
FIG. 3B is an axial sectional view of the circulation sub of FIG. 2B taken along lines 3B-3B and in accordance with the present invention.

FIGS. 3A and 3B are axial sectional views of the bypass sub 22 respectively taken along lines 3A-3A of FIG. 2A and 3B-3B of FIG. 2B. More specifically, as shown in FIG. 3A, the solid portion of the sleeve 44 is intersecting the ports 24 thereby blocking any fluid flow from annulus 36 to outside of the bypass sub 22. In FIG. 3B, the sleeve 44 has moved axially in response to fluid 58 impinging on the piston head 46 (FIG. 2B) so that openings 54 register with ports 24; which allows flow in annulus 36 to escape outside of the bypass sub 22. In the embodiment of FIGS. 3A and 3B ports 24 and openings 54 are shown strategically oriented at selected angular positions around the circumference of the sleeve 44 and the sidewall 26. Moreover, while the example of FIGS. 3A and 3B depicts four ports 24 and openings 54, embodiments exist having a fewer or greater number of ports 24 and openings 54.

Figure 4A:
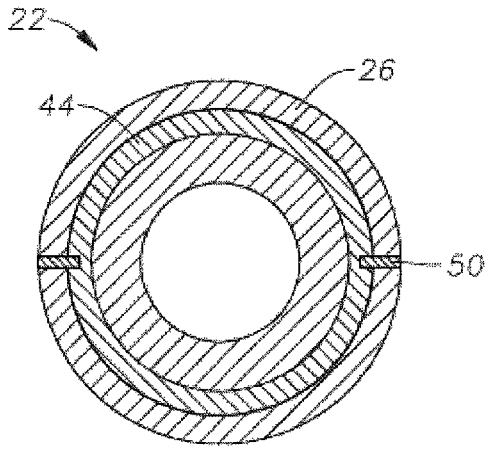
FIG. 4A is an axial sectional view of the circulation sub of FIG. 2A taken along lines 4A-4A and in accordance with the present invention.
Figure 4B:
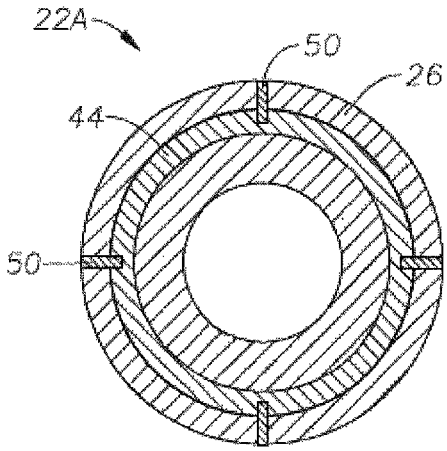
FIG. 4B is an alternate embodiment of the circulation sub of FIG. 4A in accordance with the present invention.
Figure 5A:
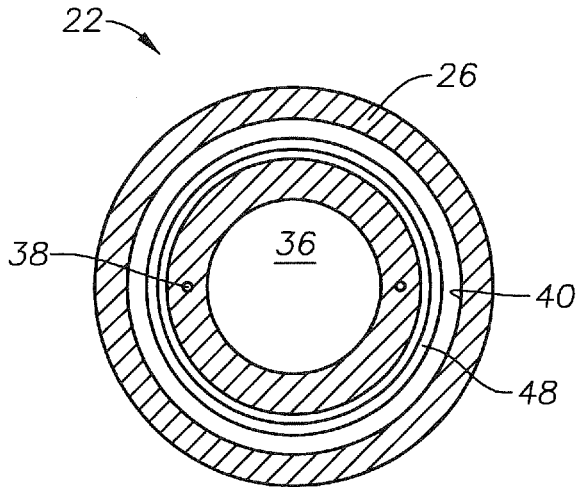
FIG. 5A is an axial sectional view of the circulation sub of FIG. 2A taken along lines 5A-5A and in accordance with the present invention.
Figure 5B:
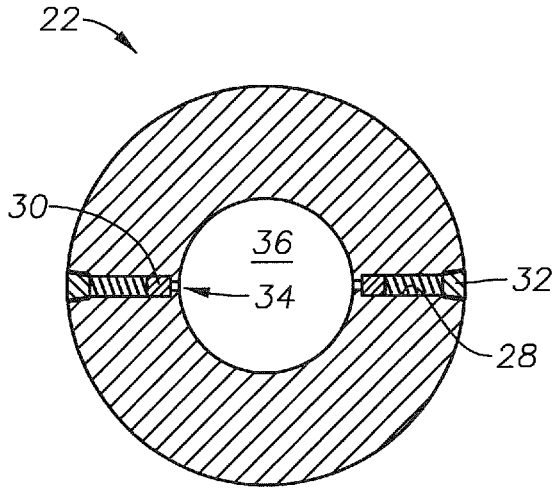
FIG. 5B is an axial sectional view of the circulation sub of FIG. 2A taken along lines 5B-5B and in accordance with the present invention.

FIG. 4A illustrates one example in an axial sectional view of the bypass sub 22 and taken along lines 4A-4A of FIG. 2A. In this example, two shear pins 50 intersect the sleeve 44 and sidewall 26 to retain sleeve in its position of FIG. 2A. Optionally, as shown in FIG. 4B, up to four shear pins 50 are utilized for retaining the sleeve 44 in place. FIG. 5A is an axial sectional view of the bypass sub 22 taken along lines 5A-5A, wherein the spring 48 is shown set in the annular chamber 40 within sidewall 26. FIG. 5B illustrates an axial sectional view of the bypass sub 22 taken along lines 5B-5B, wherein the spring valves 30 are in bores 28 and each has an inner radial portion facing the inlet 34 and blocking flow from annulus 36 and into passage 38 (FIG. 2A). Plugs 32 on the outer radial end of the spring valves 30 retain the spring valves 30 in the bores 28.

Figure 6A:
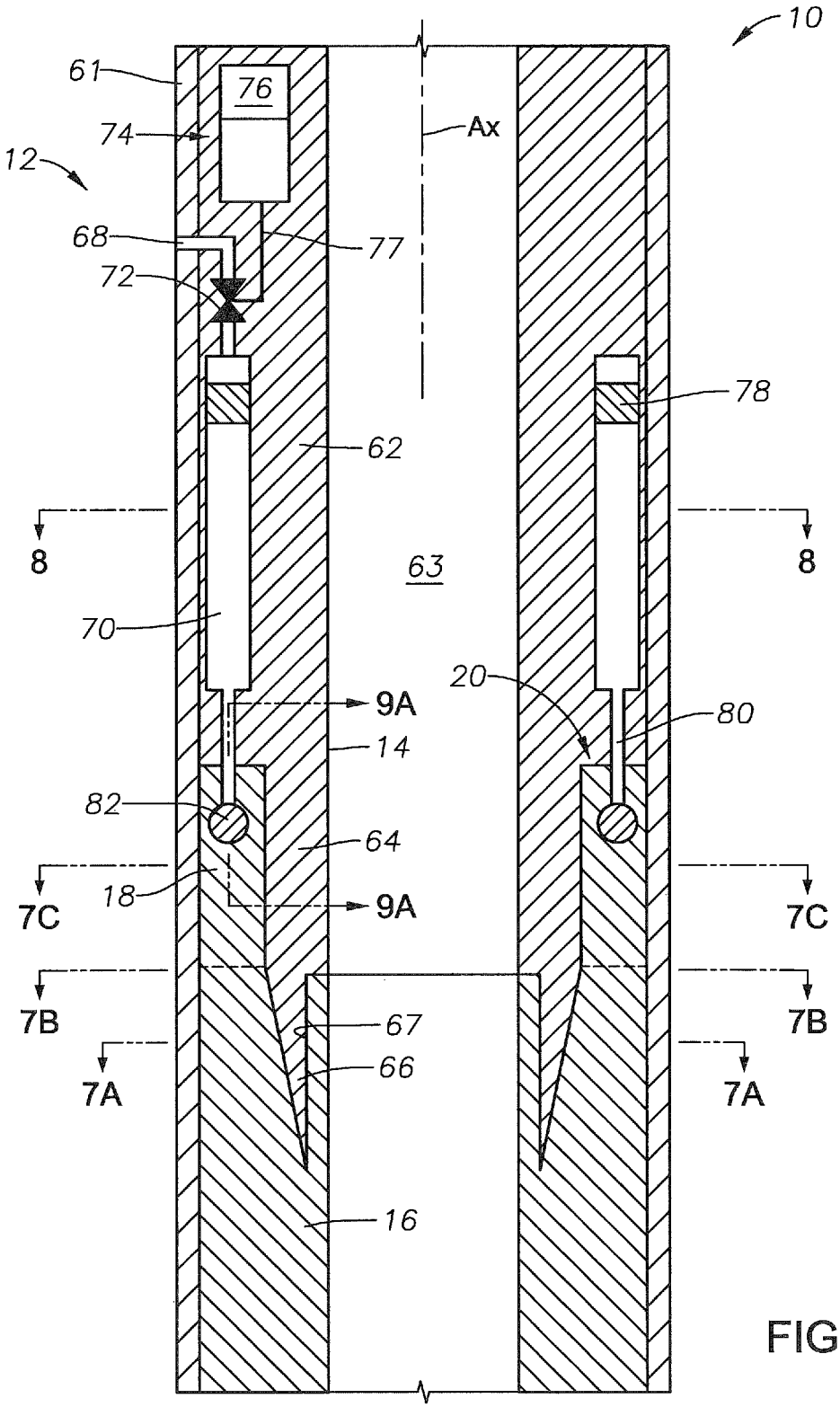
FIG. 6A is a side sectional view of an example of a disconnect sub in the downhole tool of FIG. 1 in a latched configuration and in accordance with the present invention.

FIG. 6A is a side sectional view of a portion of the disconnect sub 12 with its upper and lower members 14, 16 in a connected configuration. Further in the example of FIG. 6A, a housing 61 covers the upper and lower members 14, 16. Radially inward from the housing 61 the upper sub 14 is made up of an elongated body 62 having a generally cylindrical outer surface, and an bore 63 formed along its axis $A_X$. In an example, the bore 63 has a generally circular cross section. A skirt member 64 depends axially from a lower end of the body 62, and whose radial cross section is thinner than that of the body 62. In the illustrated embodiment, the outer radius of the skirt 64 is less than the outer radius less of the body 62, thereby defining an inner radial surface of the slot 20 where the skirt 64 is set radially inward from clutch member 18. The skirt 64 is generally annular and has a rectangular cross section as shown. Depending axially from the skirt 64 is a wedge portion 66 that as shown, is a generally annular portion having a wedge shaped cross section with inner and outer radial sides that angle towards one another and form a point at an end of wedge portion 66 distal from the skirt 64. The upper end of the wedge section 66, which is proximate the skirt 64, has an outer radius substantially similar to an outer radius of the skirt section 64, but has an inner radius set radially outward from an inner radius of skirt section 64. Wedge section 66 inserts within a correspondingly shaped chamber 67 formed in the body of the lower member 16 and with an open end facing towards skirt 64.

Still referring to FIG. 6A, an inlet line 68 is shown passing radially inward through the housing 61 and into the body 62. Within the body 62, the inlet line 68 courses into an axial direction and terminates at, and into communication with, an upper end of a cylinder 70. The cylinder 70 is formed within the body 62 of FIG. 6A and has an elongate side shown extending generally parallel with an axis $A_X$ of the downhole tool 10. In one example the cylinder 70 can be a single cylindrically shaped cylinder formed through the body 62. Optionally, the cylinder 70 can be an annular space in the body 62, or a number of separate and distinct cylinders 72 formed in the body 62 at circumferential locations within the body 62. A selectively open and closed valve 72 is shown set within inlet line 68 for controlling flow through inlet line 68. In the example of FIG. 6A, a controller 74 is provided within body 62 that provides a means for controlling the selective opening and closing of valve 72. In the embodiment of FIG. 6A, the controller 74 is coupled with a motion detector 76 that may detect motion of the downhole tool 10 and generate signals sent to a processor (not shown) within the controller 74. Depending on an amount of time detected in the controller 74 between successive episodes of movement, a signal may be delivered to the valve 72 via control line 77 for selectively opening and closing valve 72. In one example of operation, the motion detector 76 collects tool motion data about every 30 minutes. Examples of time periods where no motion is detected that would trigger the controller 74 to open the valve 72 include 8, 10, 12, or more hours.

When the valve 72 is in an open position, fluid ambient in a wellbore may flow through inlet line 68 and into an upper end of cylinder 70. A piston 78 is within cylinder 70, and depending on the flow of fluid into the cylinder 70, the piston 78 can be moved axially within the cylinder 70 in a direction away from inlet line 68. Fluid resident in cylinder 70 and below piston 78 can be urged from the cylinder 70 by movement of piston 78. The fluid urged out of the cylinder 70 flows into an outlet line 80 shown connected to an end of the cylinder 70 distal from where inlet line 68 connects to cylinder 70. As will be described in more detail below, urging fluid at a designated pressure through the outline line 80 actuates a latch rod 82 that couples clutch member within slot 20. In the example of FIG. 6A, the slot 20 defines an area within body 62 profiled at a radius set within housing 61 and along an axial distance to define an opening that receives the clutch member 18 therein.

Figure 6B:
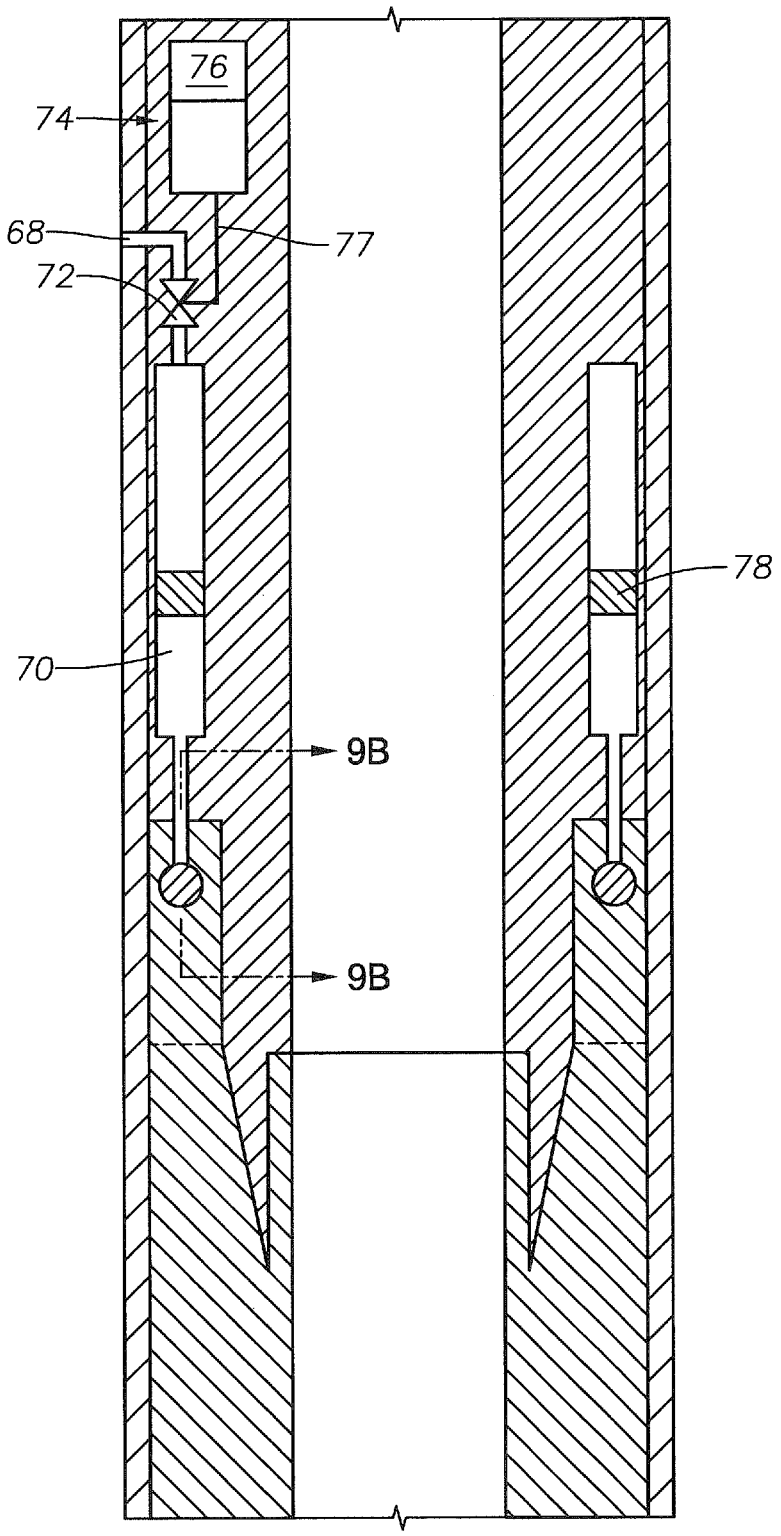
FIG. 6B is a side sectional view of an example of the disconnect sub of FIG. 6A changing from a latched configuration to an unlatched configuration and in accordance with the present invention.
Figure 6C:
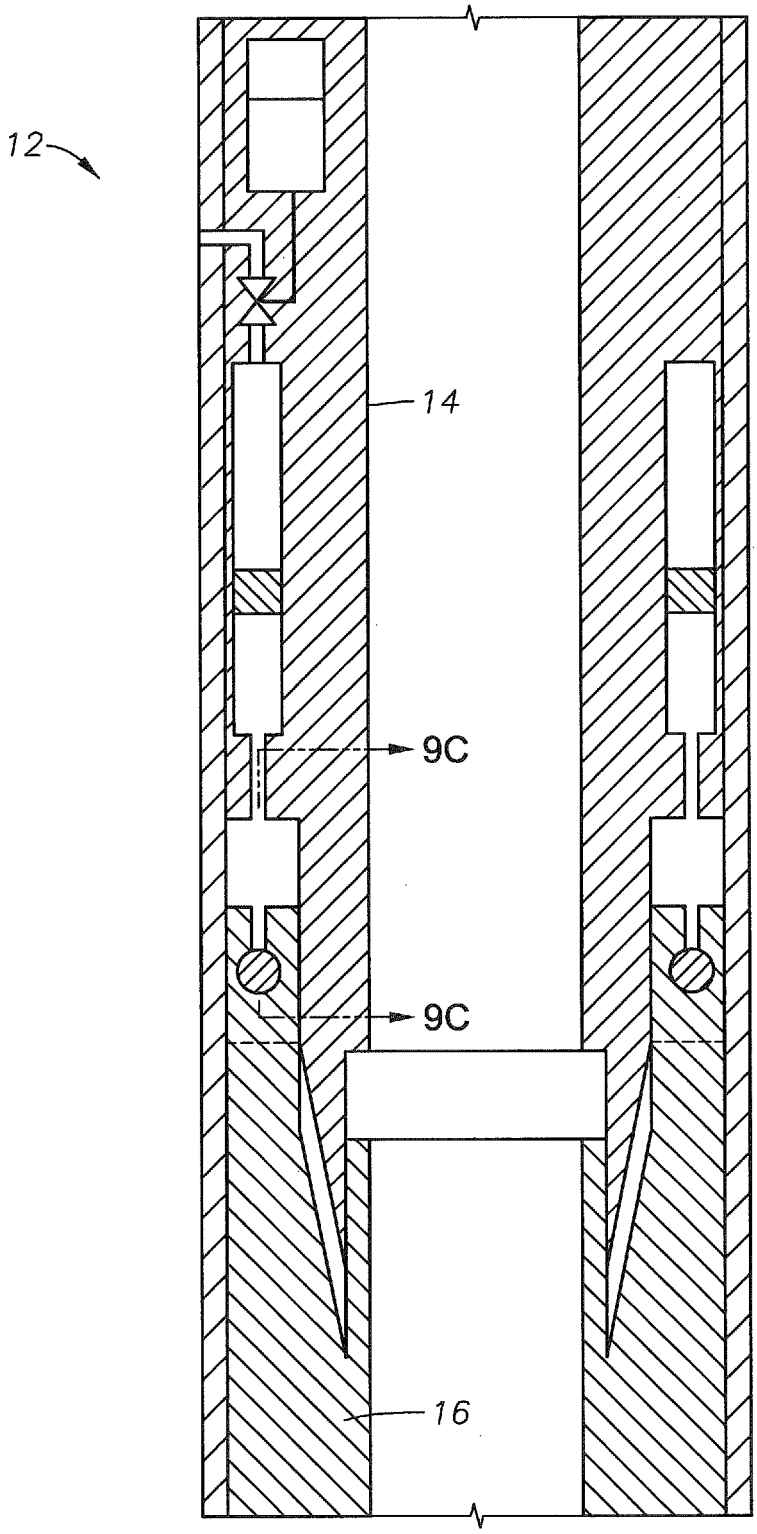
FIG. 6C is a side sectional view of an example of the disconnect sub of FIG. 6A in an unlatched configuration and in accordance with the present invention.

Referring now to FIG. 6B, in this example embodiment the motion detector 76 has sensed no motion of the downhole tool 10 and generated and sent signals to the controller 78 representing the motionless downhole tool 10. After receiving a successive string of "motionless" signals from the motion detector 76 indicating the downhole tool 10 has remained stationary for at least a designated time period; the controller 78 generates a signal and sends the signal through the control line 77 to open valve 72. Opening the valve 72 allows fluid in the wellbore to flow into cylinder 70 and urge piston 78 away from inlet line 68. FIG. 6C illustrates how the upper and lower members 14, 16 of the disconnect sub 12 of FIG. 6B can be decoupled from one another by manipulating the position of the latch rod 82.

Figure 9A:
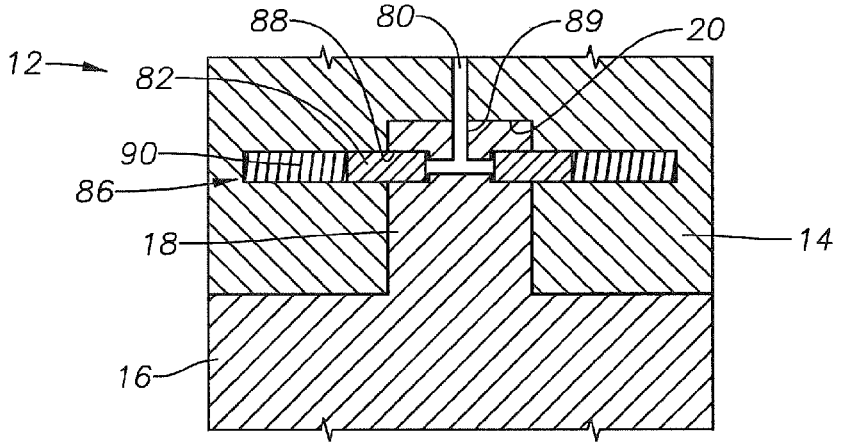
FIG. 9A is a side sectional view of the circulation sub of FIG. 6A taken along lines 9A-9A and in accordance with the present invention.

A detailed example of an interface between the clutch member 18 and slot 20 is shown in a side sectional view in FIG. 9A. In the example embodiment of FIG. 9A, the upper and lower members 14, 16 are illustrated coupled together by the latch rod 82. Chamber 86 is shown in the body 16 of upper member 14 that registers with a chamber 88 in the clutch member 18; where the latch rod 82 projects laterally into both chambers 86, 88. The presence of the latch rod 82 in the chambers 86, 88 retains the clutch member 18 in the slot 20, thereby coupling the upper and lower members 14, 16. Further illustrated in FIG. 9A is that the outlet line 80 terminates at an interface between the lower end of slot 20 and upper end of clutch member 18 and registers with a manifold port 89 shown formed within the clutch member 18. The manifold port 89 extends axially through a portion of the clutch member 18, splits into two laterally directed branches that intersect with ends of the chambers 88 formed laterally through the clutch member 18. Springs 90 are shown set within chamber 86 for biasing the latch rod 82 in a position within both chamber 86 and chamber 88 for coupling upper and lower members 14, 16.

Figure 9B:
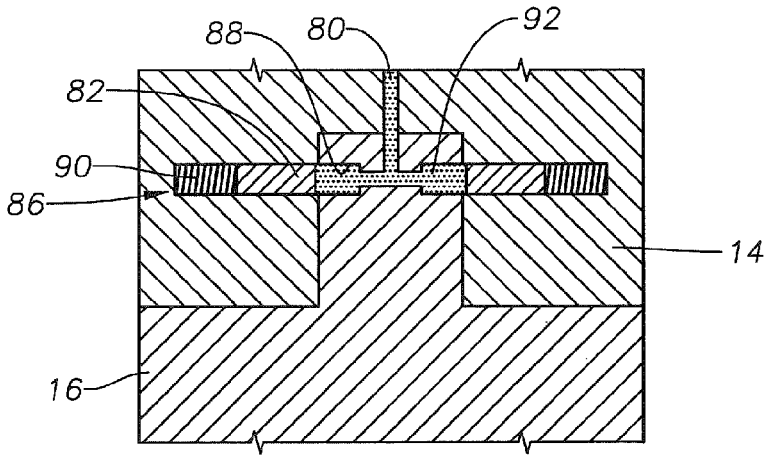
FIG. 9B is a side sectional view of the circulation sub of FIG. 6B taken along lines 9B-9B and in accordance with the present invention.
Figure 9C:
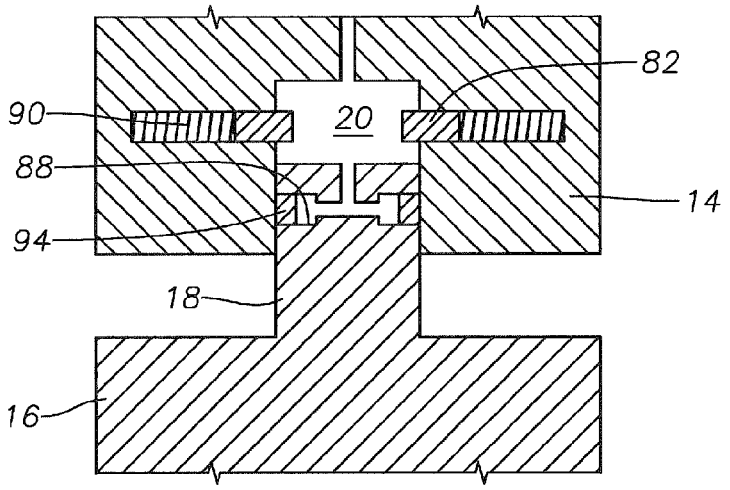
FIG. 9C is a side sectional view of the circulation sub of FIG. 6C taken along lines 9C-9C and in accordance with the present invention.

FIG. 9B, taken along line 9B-9B of FIG. 6B, illustrates a side sectional view of the example of FIG. 9A where fluid 92 being forced from cylinder 70 by piston 78 (FIG. 6B) flows through outlet line 80, into manifold port 89, and urges the latch rods 82 laterally outward from within chambers 88 solely into chambers 86, and compressing springs 90. Realigning the latch rod 82 so it no longer extends into both chambers 86, 88 decouples the clutch member 18 and slot 20. Thus, as shown in FIG. 9C, the upper and lower members 14, 16 can be separated from one another as the clutch member 18 is allowed to pull axially from within slot 20. FIG. 9C, taken along lines 9C-9C of FIG. 6C, illustrates an embodiment where a portion of the latch rod 82 defines a sealing piston 94 that shears from the latch rod 82 and remains in chamber 88. Decoupling the upper and lower members 14,16 so that the clutch member 18 pulls out from slot 20 allows springs to bias latch rod 82 into the space in the slot 20 formerly occupied by clutch member 18. In an example, one or more of the latch rods 82, springs 90, outlet line 80, and chambers 86, 88 can be collectively referred to as a latch assembly.

Figure 7A:
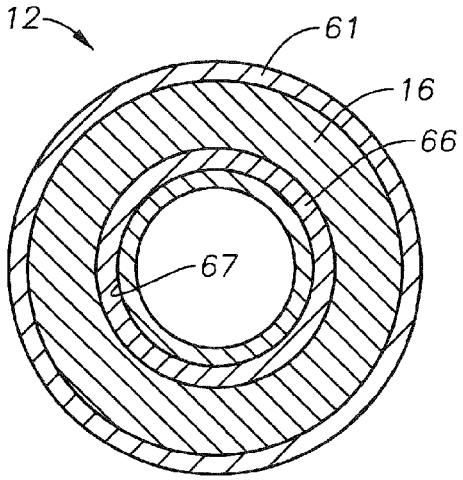
FIG. 7A is an axial sectional view of the circulation sub of FIG. 6A taken along lines 7A-7A and in accordance with the present invention.
Figure 7B:
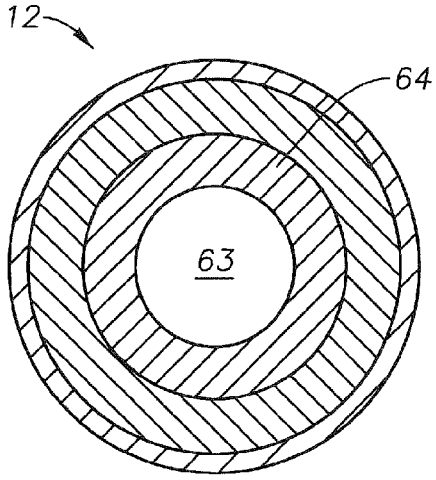
FIG. 7B is an axial sectional view of the circulation sub of FIG. 6A taken along lines 7B-7B and in accordance with the present invention.
Figure 7C:
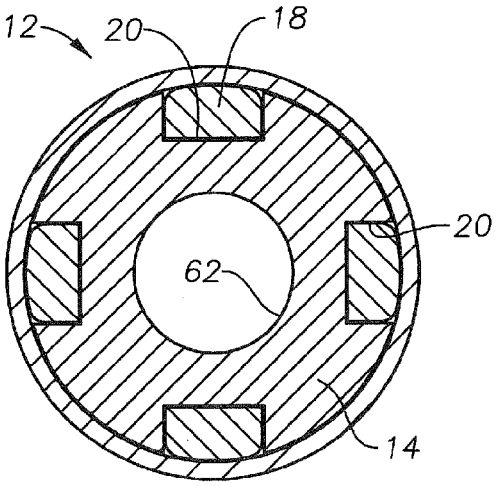
FIG. 7C is an axial sectional view of the circulation sub of FIG. 6A taken along lines 7C-7C and in accordance with the present invention.
Figure 8:
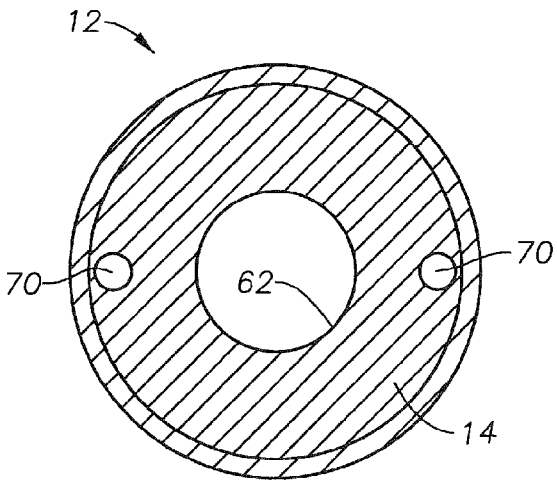
FIG. 8 is an axial sectional view of the circulation sub of FIG. 6A taken along lines 8-8 and in accordance with the present invention.

FIGS. 7A through 7C are axial sectional views of the downhole tool 10 of FIG. 6A taken respectively along lines 7A-7A, 7B-7B, and 7C-7C. As shown, in FIG. 7A, the wedge section 66 is within chamber 67 formed through the body of the lower member 16. FIG. 7B illustrates how the inner diameter of the skirt 64 interfaces within outer circumference of annulus 84. In FIG. 7C an axial view illustrates how a portion of the clutch member 18 inserts within the slots 20 that extend axially through the body 62 of the upper member 14. In the example of FIG. 7C, the lateral and inward facing surfaces of the clutch members 18 are substantially linear, whereas the radially outward facing surfaces of each clutch member 18 are curved and extend substantially to the outer radial thickness of the body 62. Referring now to FIG. 8, an axial view of the disconnect sub 12 is shown and taken along line 8-8 wherein the cylinders 70 are shown spaced angularly apart at locations within the body 62 of the upper member 14. In the example of FIG. 8 also the outer periphery of the cylinder 70 is shown having a substantially rectangular shape. Optionally, the cylinder 70 can have a circular or other curved shape.

Figure 10:
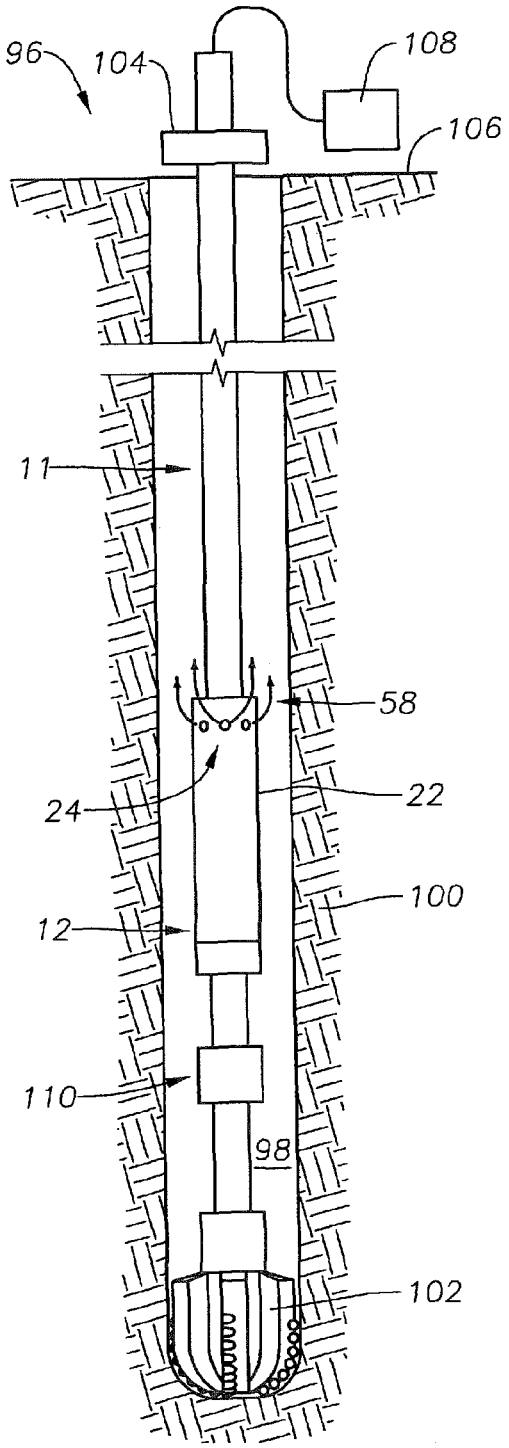
FIG. 10 is a side partial sectional view of a drill string recirculating fluid through an embodiment of a downhole sub in accordance with the present invention.

FIG. 10 is a partial side sectional view illustrating that the downhole tool 22 and drill string 11 are part of a drilling system 96 for forming a wellbore 98 through a subterranean formation 100. The drilling system 96 further includes a bit 102 on a lower end of the string 11 for excavating the wellbore 98. A drive assembly 104 is shown on surface 106 for rotating the string 11. A fluid supply system 108 provides pressurized fluid to the drill string 11 that exits the bit 102 and flows back to surface 106 in the annular space between the walls of the wellbore 98 and outer surface of the drill string 11. In one example of operation, the fluid supply system 108 delivers pressurized fluid 58 into the drill string 11; where the pressurized fluid 58 is shown exiting from ports 24 on the bypass sub 22. In the illustrated example a blockage in the string 11 downstream of the bypass sub 22 increases pressure within the annulus 36 (FIGS. 2A and 2B) to above a threshold value that moves the sleeve 44 into its position of FIG. 2B thereby providing communication between the annulus 36 and wellbore 98; which allows the pressurized fluid 58 to exit the ports 24. Still referring to FIG. 2B, it should be pointed out that when pressure in the annulus 36 drops below the designated set pressure for actuating the sleeve 44, potential energy stored in the springs 48 can bias the piston head 46 and sleeve 44 back to their position of FIG. 2A. In the configuration of FIG. 2A, the fluid 58 is blocked from exiting ports 24 and instead resumes its flow through the drill string 11 where it can be directed out from the bit 102. Referring back to FIG. 10, a downhole tool 110 is shown included with the drill string 11 in a space between the disconnect sub 12 and drill bit 102. Examples of the downhole tool 110 can include imaging tools for use in logging while drilling (LWD), such as a nuclear source density tool, gamma ray tools, resistivity tools, and the like. An advantage of the bypass sub 22 is that recirculation of the pressurized fluid 58 is activated by a value of the pressure of the pressurized fluid 58, rather than introducing a pressure drop in the flow of the fluid 58. Activating the bypass sub 22 on pressure rather than flow rate provides for continued fluid circulation into the wellbore 98 which maintains hydrostatic pressure at the bottom of the wellbore 98 and prevents an underbalanced condition. Moreover, known systems that induce a pressure drop in the string to activate a bypass flow can reduce operability of the drilling system as a whole.

Figure 11:
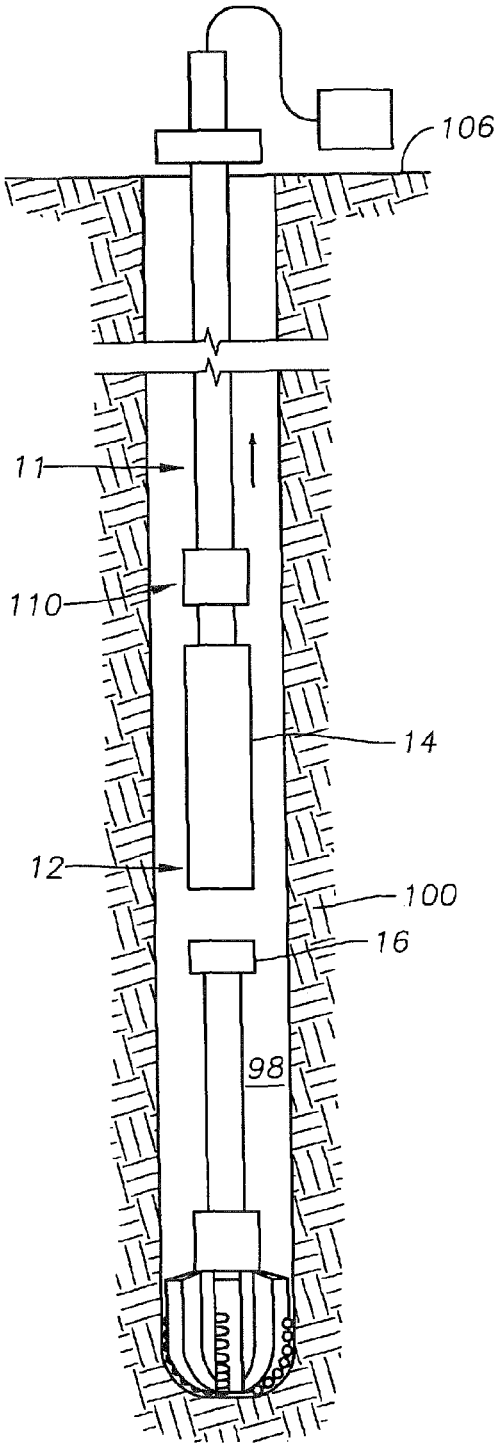
FIG. 11 is a side partial sectional view of a drill string having a downhole sub with a disconnecting portion in accordance with the present invention.

FIG. 11 provides a side partial sectional view of an example of the upper and lower members 14, 16 of the disconnect sub 12 being separated after being decoupled from one another. In the example of FIG. 11, upper and lower members 14, 16 are separated by pulling the string 11 upward from the wellbore 98. One manner of decoupling upper and lower members 14, 16 is described above and depicted in the examples of FIGS. 6A-6C and 9A-9C. In the example of FIG. 11, the downhole tool 110 is above the disconnect sub 12 and can be retrieved along with the portion of the string 11 being removed from the wellbore 98. Thus the option exists to position the downhole tool 110 above or below the disconnect sub 12, without affecting operation of the disconnect sub 12. An advantage of multiple positioning of the downhole tool 110 is that imaging results may dictate positioning, or that a desire may exist to not leave the downhole tool 110 in the wellbore 98 when removing an unstuck portion of the drill string 11, but instead to bring the downhole tool 110 to surface 106 for data analysis, repair, inspection, or other operational purposes.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A downhole sub that is selectively coupled in series with a drill string comprising:

a bypass sub having a housing with an outer surface;

a bore axially disposed in the housing;

a relief valve assembly in a side wall of the housing that is selectively moveable from a closed position with the outer surface isolated from the bore to an open position with the fluid communication between the bore and outer surface; and a passage in the side wall of the housing having an end in communication with the bore and a distal end in communication with the relief valve assembly that terminates within the housing and that is isolated from the outer surface of the housing, the passage selectively routing fluid from the bore to the relief valve assembly, so that when the fluid in the bore is at a designated pressure, the fluid in communication with the relief valve assembly exerts a force onto the relief valve assembly to move the relief valve assembly into the open position.

2. The downhole sub of claim 1, wherein the relief valve assembly comprises an annular space formed axially in the side wall of the housing, a sleeve axially moveable in an annular space formed axially in the side wall of the housing, an opening radially formed through a side wall of the sleeve, and a port formed radially through the housing that registers with the opening when the valve assembly is in the open position.

3. The downhole sub of claim 2, further comprising a poppet valve in the passage that is selectively moveable to an open position when pressure in the bore exceeds a designated value.

4. The downhole sub of claim 2, further comprising a piston head on an end of the sleeve that has a high pressure side in pressure communication with the passage, and a spring on a side of the piston distal from the high pressure side to bias the piston and sleeve into the closed position.

5. The downhole sub of claim 1, wherein the bore has diameter with a magnitude that remains substantially the same along a length of the bore.

6. The downhole sub of claim 1, further comprising a disconnect sub having upper and lower members that are selectively coupled by a latch assembly that selectively operates in response to when the sub is stationary for a designated period of time.

7. The downhole sub of claim 6, further comprising a motion detector and a controller for actuating the latch assembly.

8. The downhole sub of claim 7, further comprising a piston movable in a cylinder that is axially formed within the disconnect sub and having a low pressure side in communication with the latch assembly, a pressure vent in communication with fluid ambient to the sub system and having an end intersecting a high pressure end of the cylinder, a control valve for controlling flow through the pressure vent, and a controller for controlling operation of the control valve and that is in communication with the motion detector, so that when the motion detector detects a period of time that the sub system is motionless which exceeds a designated period of time, the controller directs the control valve to open, which pressurizes the cylinder and actuates the latch assembly.

9. The downhole sub of claim 8, wherein the latch assembly comprises a latch rod that selectively moves from within interfering contact between the upper and lower members into a one of the upper or lower members.

10. The downhole sub of claim 9, wherein the lower member comprises elongated clutch members that project axially into slots on the upper segment and wherein the latch rod extends from within a chamber in each of the clutch members and into a chamber in each of the slots when the upper and lower members are connected to one another, and where the latch rod is withdrawn from one of the chambers when the upper and lower members are separable.

11. The downhole sub of claim 1, wherein the relief valve assembly is moveable to the open position in response to a pressure in the bore being at a designated value.

12. A downhole sub that is selectively coupled in series with a drill string comprising:

a bypass sub having a housing with an outer surface;

a bore axially disposed in the housing;

a relief valve assembly in a side wall of the housing that is selectively moveable from a closed position with the outer surface isolated from the bore to an open position with the fluid communication between the bore and outer surface;

a disconnect sub having upper and lower members selectively coupled by a latch assembly;

an actuation system in communication with the latch assembly and in communication with fluid ambient to the downhole sub;

a motion detector; and a controller in communication with the motion detector and the actuation system, so that when the motion detector senses that the downhole sub has been motionless for at least a designated period of time, the actuation system is directed to disconnect the upper and lower members.

13. The downhole sub of claim 12, wherein a bit is mounted on a lower terminal end of the drill string, and a downhole tool is between the downhole sub and the bit.

14. The downhole sub of claim 12, wherein a downhole tool is mounted in a portion of the drill string between the downhole sub and an opening of a wellbore in which the drill string is inserted.

* * * * *